US006453641B1

(12) United States Patent
Puckett

(10) Patent No.: US 6,453,641 B1
(45) Date of Patent: Sep. 24, 2002

(54) REPLACEABLE CAP SUPPLY CARTRIDGE

(75) Inventor: George R. Puckett, Paris, TN (US)

(73) Assignee: National Scientific Company, Lawrenceville, GA (US)

( * ) Notice: Subject to any disclaimer, the term of this patent is extended or adjusted under 35 U.S.C. 154(b) by 0 days.

(21) Appl. No.: 09/548,230

(22) Filed: Apr. 12, 2000

Related U.S. Application Data

(62) Division of application No. 08/996,391, filed on Dec. 22, 1997, now Pat. No. 6,058,683.

(51) Int. Cl.[7] ..... B65B 7/28

(52) U.S. Cl. ..... 53/305; 53/310; 53/313; 193/27; 221/197; 221/287; 221/312 R; 221/155

(58) Field of Search ..... 53/305, 306, 310–313; 193/27; 221/197, 287, 312 R, 155

(56) References Cited

U.S. PATENT DOCUMENTS

| | | | | | |
|---|---|---|---|---|---|
| 553,757 | A | * | 1/1896 | Lipphardt et al. | 53/310 X |
| 586,613 | A | | 7/1897 | Muslar | |
| 651,050 | A | | 6/1900 | Muslar | |
| 1,562,599 | A | * | 11/1925 | Suiter | |
| 1,955,704 | A | * | 4/1934 | Bahelka | 53/313 X |
| 2,049,761 | A | * | 8/1936 | Daniels | 53/305 |
| 2,159,905 | A | * | 5/1939 | Moninger | |
| 2,173,122 | A | | 9/1939 | Mancuso | |
| 2,501,291 | A | | 3/1950 | Rue | |
| 2,682,986 | A | * | 7/1954 | Jonsson | 53/310 |
| 3,975,886 | A | * | 8/1976 | Waters | 53/310 |
| 3,998,032 | A | | 12/1976 | Koebbeman | |
| 4,160,352 | A | | 7/1979 | Neff | |
| 4,932,824 | A | * | 6/1990 | Goslin | 53/306 X |
| 5,511,690 | A | * | 4/1996 | Calhoun et al. | 221/197 |
| 5,746,042 | A | | 5/1998 | Lombardi | |
| 5,778,635 | A | * | 7/1998 | Galandrino | 53/306 |

FOREIGN PATENT DOCUMENTS

| | | |
|---|---|---|
| GB | 795859 | 5/1958 |

* cited by examiner

*Primary Examiner*—Stephen F. Gerrity
(74) *Attorney, Agent, or Firm*—Wood, Herron & Evans, L.L.P.

(57) ABSTRACT

A self-feeding manual cap crimper, indexing mechanism and replaceable cap cartridge provide benefits related to quickly sealing crimp top vials or bottles. A conventional manually operated cap crimping mechanism may be utilized in conjunction with a cap indexing mechanism and a replaceable cap cartridge constructed in accordance with the invention. The replaceable cap supply cartridge includes a main body having a cap containment portion which serially feeds caps to the cap indexing mechanism. The cap indexing mechanism and the replaceable cartridge may each be releasably connected to the cap crimping mechanism. A first actuation of the cap crimping mechanism feeds a cap proximate to multiple jaws associated with the crimping mechanism. A second actuation moves the jaws and crimp the cap onto the vial or bottle.

8 Claims, 6 Drawing Sheets

REPLACEABLE CAP SUPPLY CARTRIDGE

CROSS REFERENCE TO RELATED APPLICATIONS

This application is a division of U.S. patent application Ser. No. 08/996,391, filed Dec. 22, 1997, now U.S. Pat. No. 6,058,683.

BACKGROUND OF THE INVENTION

The present invention generally relates to sealing vials or bottles with caps and, more specifically, to manually operated crimping devices used for such purposes.

In the area of scientific or medical testing, for example, small vials may be filled with a liquid and sealed with an appropriate cap. Some vials and caps may include mating threads for securing the cap to the vial and other caps may be pressed or snapped onto the vial. The present invention is related to vials that require a cap or seal to be crimped onto the open end of the vial. These vials may be referred to as crimp top vials and the crimp cap or seal must often be connected to the vial in a hermetically sealed manner.

In many testing facilities, it is common to use a manually operated cap crimping device essentially comprising a set of jaws actuated by a pair of handles to crimp a cap onto the open end of a vial. One such crimping device may be obtained from National Scientific Company, based in Lawrenceville, Ga., under Catalog No. C4012-100. Although several types of manually operated crimping devices are known, each type generally requires that the user manually place a cap onto the vial before each crimping operation. That is, these devices do not feed caps to the crimping mechanism. Quite often, a testing laboratory may be automated to handle the testing of several hundred or thousands of vials of liquid per day. In gas chromatography testing, for example, automated sampling devices may utilize trays holding one hundred or more sealed vials. When lab technicians or other scientific or medical personnel are dealing with such high numbers of test vials each day, the manual crimping operation is quite time consuming and labor intensive.

For at least the above reasons, it would be desirable to provide various improvements to manually operated crimping devices for allowing the user to more quickly and efficiently fill and seal numerous vials or bottles, while still enabling the use of a relatively simple and inexpensive manually operated cap crimping device.

SUMMARY OF THE INVENTION

To address the above noted problems, the present invention contemplates a manually operable cap crimping device that includes a crimping mechanism, which may be conventional in design, and a unique cap indexing mechanism operating in conjunction with the crimping mechanism. The crimping device may also include a replaceable cap supply cartridge. A crimping and indexing actuator, such as a handle of the crimping device, alternately operates the cap indexing mechanism and the crimping mechanism. In this manner, when the crimping and indexing actuator is actuated once by squeezing the handle, for example, a cap will be fed into position for crimping. After a vial or bottle has been inserted between jaws associated with the crimping mechanism, the handle may be actuated again causing the jaws to crimp the cap onto the vial or bottle.

As mentioned above, a unique replaceable cap supply cartridge is provided to supply caps to the indexing mechanism of the invention. The cartridge holds a large supply of caps for the crimping device and serially feeds caps to the crimping mechanism preferably by way of the indexing mechanism. The replaceable cap supply cartridge includes a main body having a cap containment portion for receiving a supply of crimp caps. The cap containment portion further includes an exit appropriately aligned with the cap indexing mechanism of the crimping device. A connector portion is also provided on the main body and is adapted to releasably connect the cartridge to the manually operated cap crimping mechanism in such a manner to allow the serial feeding of caps to the crimping mechanism. The connector portion is preferably a slide connector.

The main body of the cap supply cartridge preferably includes a plate member having first and second faces. The cap containment portion may advantageously comprise a serpentine-shaped recess contained in the first face. The recess is formed in a serpentine shape not only to provide for the serial feeding of caps, but also to allow for a large number of caps to be stored in a relatively small main body. At least one and preferably both side walls of the recess converge at an angle to reduce frictional contact with the caps. It is contemplated, however, that the cap containment portion may take many other forms and shapes as well. The cartridge preferably further comprises a second plate member attached to the first face to enclose the recess. This second plate member may be at least partially transparent to allow the supply of caps to be determined by the user. It is contemplated that other visible indicators of the supply of caps may also be incorporated into the cartridge. The exit of the cap containment portion is preferably located at a relative lower portion of the cartridge such that caps may be fed to the crimping mechanism by gravity.

As mentioned above, a cap indexing mechanism is provided for allowing a user to selectively feed caps proximate to a set of crimping jaws associated with the crimping mechanism of the device. The replaceable cap supply cartridge may be included as a connected part of this indexing mechanism. Generally, the cap indexing mechanism comprises cap feeding structure including a feed channel for containing a supply of caps and ending with an opening for allowing insertion of the open end of a vial or bottle. An indexing element is mounted for movement relative to the feed channel for selectively feeding caps to the opening. An index actuating member is operatively connected for movement with the indexing element and is operatively connected to the actuator of the crimping mechanism, such as one of the handles thereof. Movement of the handle will cause the index actuating member to move the indexing element and thereby selectively feed caps to the opening. The indexing element and the index actuating member preferably have cam surfaces that mate to cause movement of the indexing element upon movement of the index actuating member. A biasing element normally biases the indexing element into a position preventing movement of caps from the feed channel to the opening. The indexing element includes a slot for receiving a cap from the feed channel during an indexing operation.

The cap indexing mechanism of the invention preferably includes at least one connector for connecting the indexing mechanism to the cap crimping mechanism. This converts the crimping mechanism into a self-feeding crimping device. The feed channel of the cap indexing mechanism is curved and gravity feeds caps from a generally vertical orientation to a generally horizontal orientation with open sides of the caps facing downward at the opening. Preferably, the feed channel is a recess contained in a first curved plate member, like the replaceable cap supply cartridge mentioned above, and a second curved plate member is likewise attached to retain caps within the channel during operation. The replaceable cap supply cartridge is preferably connected with the indexing mechanism so that, operating together, the cap supply cartridge and the indexing mechanism serially feed caps to the crimping mechanism.

It will be appreciated that the present invention, including the self-feeding cap crimping device, the cap indexing mechanism, the replaceable cap supply cartridge, and various associated methods present many advantages to the user. Notably, users may apply caps to several hundred vials or bottles per day more quickly and in a more simplified manner by using the replaceable cap supply cartridge and indexing mechanism of the invention. Replaceable cartridges containing many caps may be stored and simply attached to the indexing mechanism of the cap crimping device, as necessary.

Other advantages and objects of the invention will become more readily apparent of those of ordinary skill upon review of the following detailed description taken in conjunction with the accompanying drawings.

BRIEF DESCRIPTION OF THE DRAWINGS

FIG. 1A is a cross sectional view taken along line 1A—1A of FIG. 1;

DETAILED DESCRIPTION OF THE PREFERRED EMBODIMENT

Figure 1:
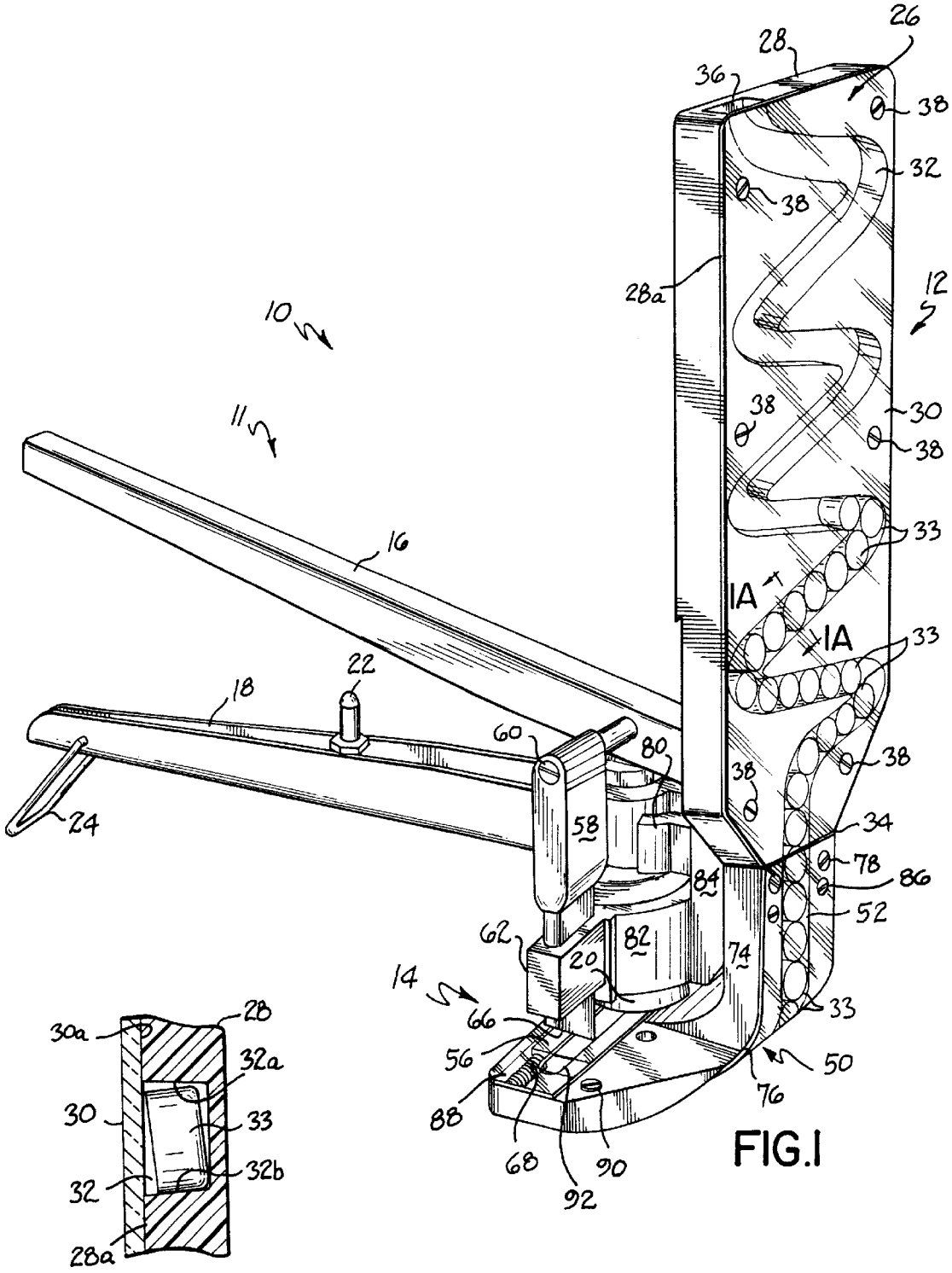
FIG. 1 is a front perspective view of a cap crimping device constructed in accordance with a preferred embodiment of the invention and including the replaceable cap supply cartridge and cap indexing mechanism of the invention.

Referring first to FIG. 1, a cap crimping device 10 is shown constructed in accordance with the present invention. Device 10 generally comprises a manually operated crimping mechanism 11, a replaceable cap supply cartridge 12 and a cap indexing mechanism 14 generally connected between crimping mechanism 11 and replaceable cap supply cartridge 12. Crimping mechanism 11 more specifically comprises a pair of handles 16, 18 operatively connected to movable jaws 20 (FIG. 2) used to crimp a cap onto a vial, in a conventional manner. Mechanism 11, including handles 16, 18, crimping jaws 20, and the various structure (not shown) necessary to operate jaws 20 with handles 16, 18, is generally known from the manual crimping mechanism described hereinabove and obtainable from National Scientific Company. As is also conventional, handle 18 further includes a stop 22 for limiting the motion of handle 16 in a downward direction during actuation of jaws 20. A connector 24 is also provided for maintaining handle 16 in position for safe storage.

Still referring to FIG. 1, replaceable cap supply cartridge 12 generally comprises a main body 26 preferably formed from a first plate member 28 and a second plate member 30. A cap containment portion, preferably in the form of a serpentine-shaped recess 32, is formed in one face of the first plate member 28. The second plate member 30 essentially closes the serpentine-shaped recess 32 and thereby contains caps 33 within recess 32. Second plate member 30 may be transparent to provide for visible indication of the supply of caps 33 within recess 32. Recess 32 includes an exit end 34 from which caps 33 are serially fed from cartridge 12. Exit end 34 is preferably disposed at a lower end of cartridge 12 such that caps 33 may be fed by gravity. An entrance end 36 may also be provided to allow filling of cartridge 12 with caps 33. Fasteners 38 may be provided for securing second plate member 30 to a first face 28*a* of first plate member 28. Any other fastening means or manner of construction may be provided. For example, all parts shown to be fixed together by fasteners may be ultrasonically welded together instead.

Briefly referring to FIG. 1A, serpentine recess 32 is shown in cross section to be comprised of opposing side walls 32*a*, 32*b* which converge at an angle away from second plate member 30. The angle of each wall 32*a*, 32*b* is preferably about 3° with respect to perpendicular to surface 28*a*. This angle prevents a significant amount of friction that would otherwise occur if side walls 32*a*, 32*b* were formed perpendicular to surface 28*a* and second plate member 30. As shown, caps 33 will be disposed at an angle which reduces contact and the resulting reduced friction with inside surface 30*a* of second plate member 30. Therefore, caps 33 may move more freely down serpentine recess 32 during operation.

Figure 2:
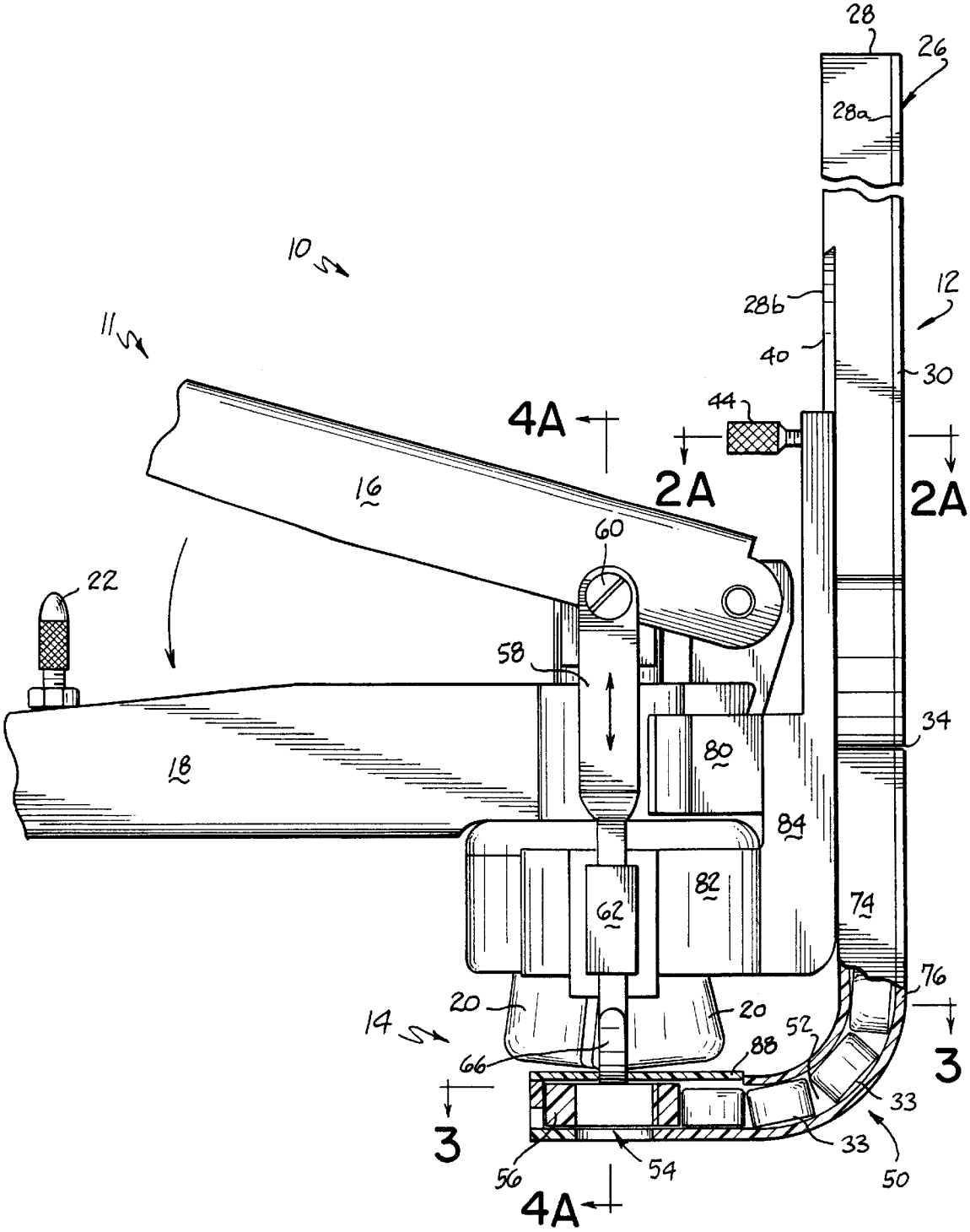
FIG. 2 is a side elevational view of the cap crimping device, partially fragmented and enlarged, to show further details of the cap indexing mechanism.
Figure 2A:
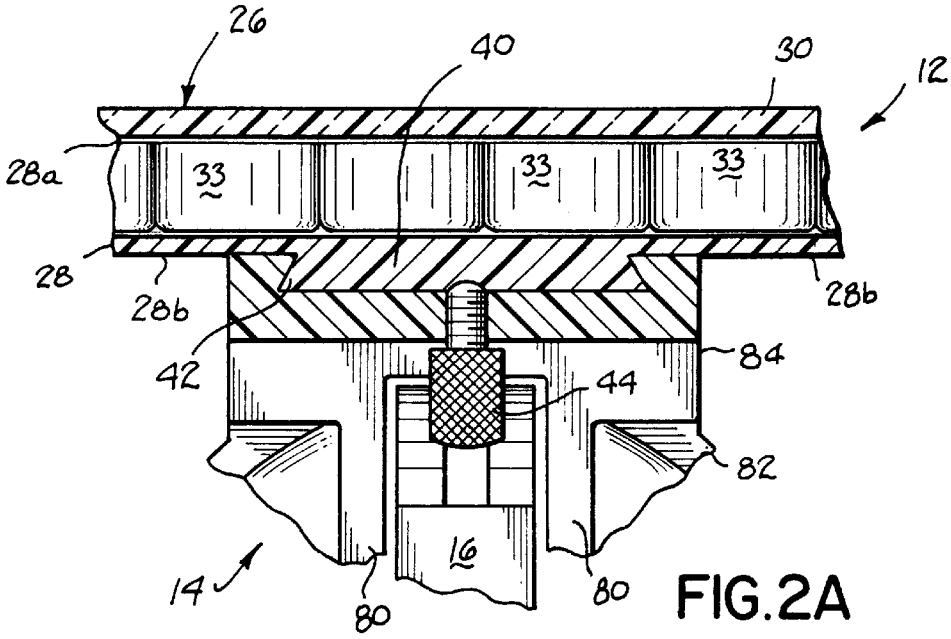
FIG. 2A is a cross sectional view taken generally along line 2A—2A of FIG. 2 and showing one manner of securing the replaceable cap supply cartridge to the indexing mechanism of the cap crimping device.

A connector portion 40, as shown best in FIGS. 2 and 2A, is provided on a second face 28*b* of first plate member 28. This connector portion 40 may take the form of a male slide connector which mates with a complementary female slide connector recess 42 which may be contained in a portion of indexing mechanism 14. A set screw 44 may also be provided for locking cartridge 12 onto indexing mechanism 14.

Figure 2B:
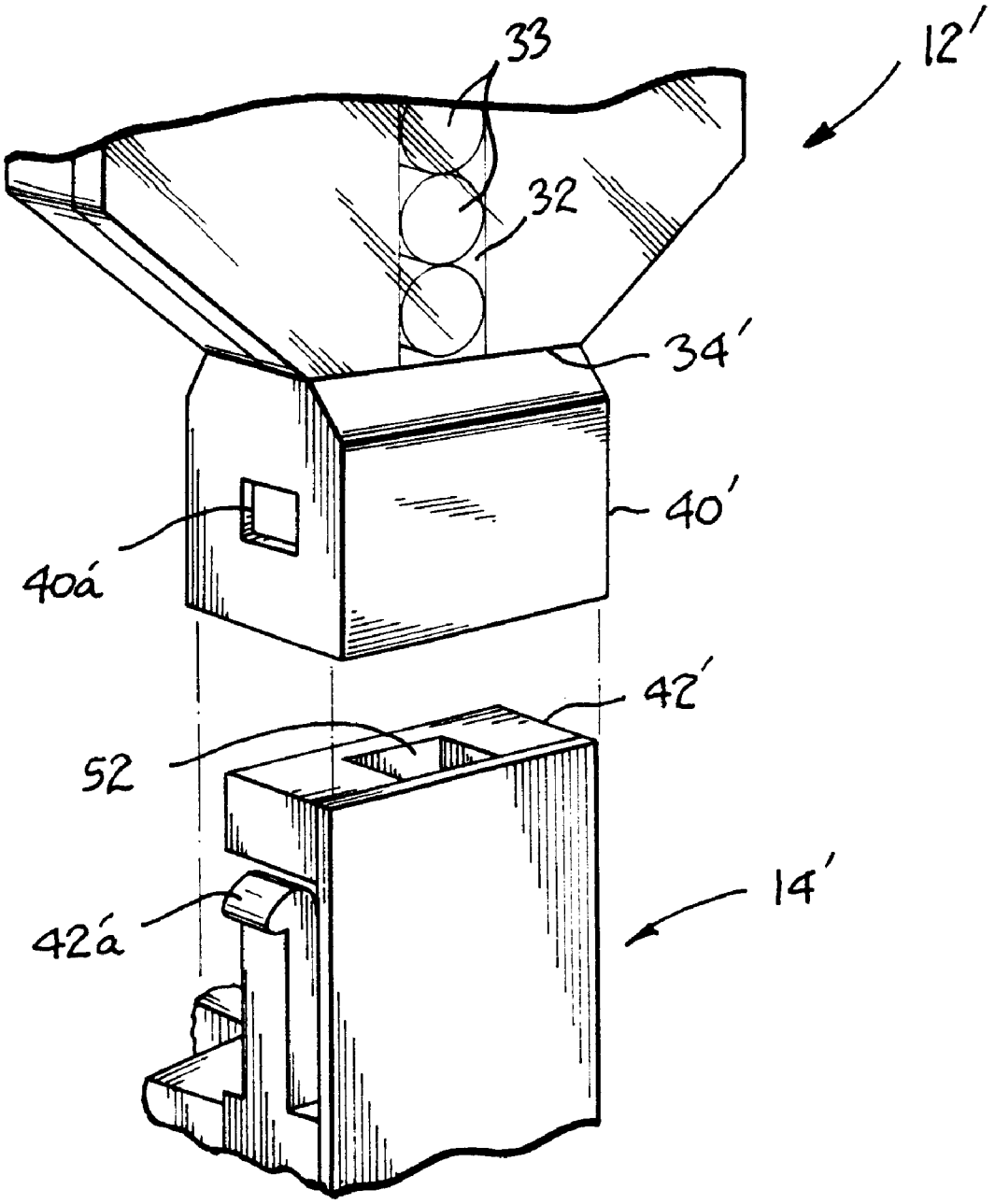
FIG. 2B is a perspective view of an alternative manner of securing the cap supply cartridge to the indexing mechanism.

Referring briefly to FIG. 2B, one alternative manner of releasably connecting replaceable cap supply cartridge 12' to a cap indexing mechanism 14' is shown. In FIG. 2B, like reference numerals having prime marks (') represent like structure relative to the first embodiment which has been modified slightly to accommodate the different connection. Specifically, the connection shown in FIG. 2B simplifies replacement and removal of cap supply cartridge 12' by providing a female slide connector portion 40' on cartridge 12' and a male slide connector portion 42' on cap indexing mechanism 14'. Slide connector portion 42' includes a resilient projection 42*a*' adapted to mate with an aperture 40*a*' in connector portion 40'. Aperture 40' could instead be a detent or recess. Thus, it will be understood that replaceable cap supply cartridge 12' may be snapped onto cap indexing mechanism 14' as connector portion 42' is received within connector portion 40' and projection 42*a*' snaps into place within aperture 40*a*'. To release this connection, the operator simply depresses projection 42*a*' and removes cap supply cartridge 12'. When snapped in place, serpentine recess 32 registers at exit end 34' with recess 52 in cap indexing mechanism 14'.

Figure 3:
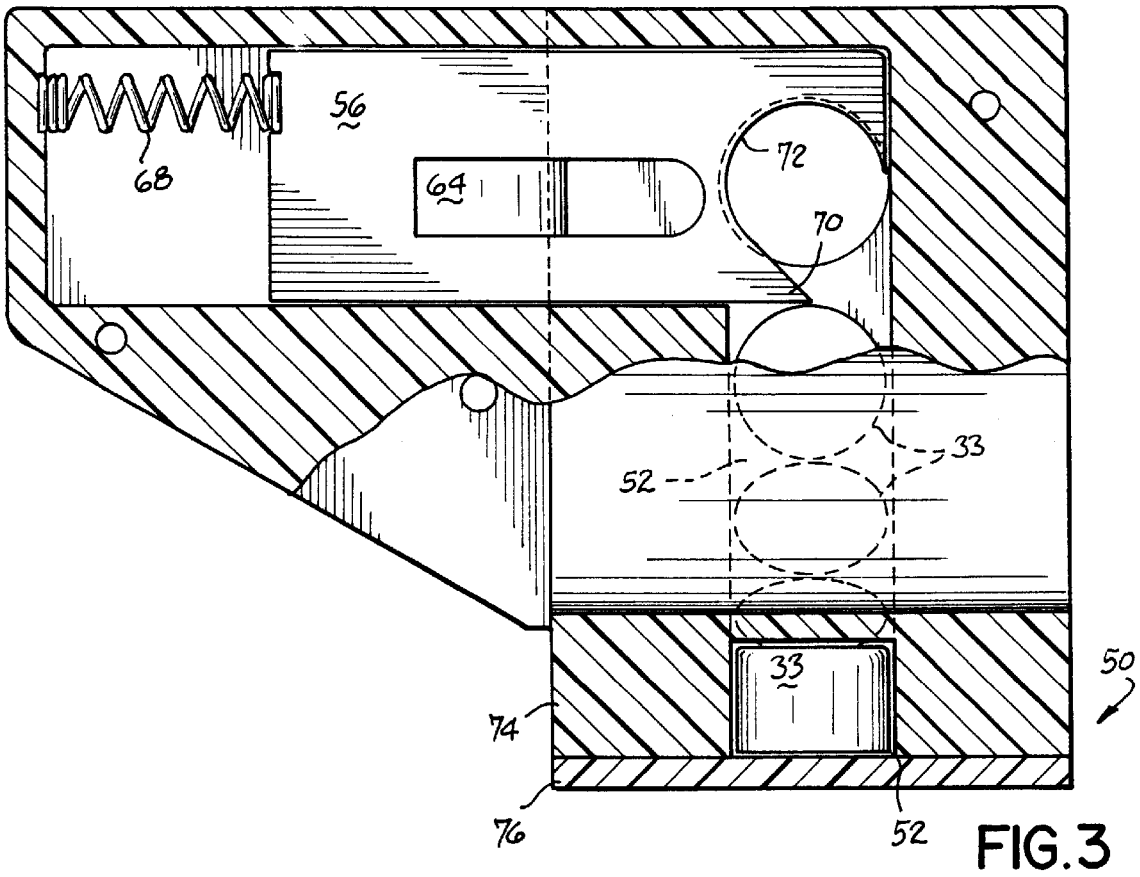
FIG. 3 is a cross sectional view of the cap indexing mechanism generally taken along line 3—3 of FIG. 2.

Referring again to FIG. 1, cap indexing mechanism 14 more specifically comprises cap feeding structure 50 including a curved cap feed channel 52. As shown best in FIG. 2, feed channel 52 includes an opening 54 essentially normal to the lower, generally horizontal portion thereof. Caps 33 are received in line with opening 54 during an indexing operation as will be described. As also generally shown in FIG. 2, caps 33 move from an initially generally vertical orientation to a generally horizontal orientation at opening 54. Referring to FIGS. 1 and 4A–4C, an indexing element 56 is provided and operatively connected to an index actuating member 58 connected to handle 16 of crimping mechanism 11 by a pivot connection 60 (FIG. 1). Pivot connection 60 may include conventional threaded fastening elements, such as a screw and an internally threaded pivot pin. In this manner, pivot connection may be releasable to convert device 10 back into a non-feeding crimping mechanism. Index actuating member 58 is contained for reciprocating movement in a vertical direction within a guide 62. As further shown in FIGS. 4A–4C, indexing element 56 and index actuating member 58 have mating cam surfaces 64, 66. Thus, when index actuating member 58 moves downwardly as viewed in FIG. 4A, indexing element 56 will move to the left due to the interaction of cam surfaces 64, 66, for reasons to be described. A biasing element 68, preferably in the form of a coil spring, maintains indexing element 56 in a position that normally prevents caps 33 from being received in to opening 54. In this normally biased position, a portion 70 of indexing element 56 blocks feed channel 52 as shown best in FIG. 3. When indexing element 56 is moved to the left as viewed in FIG. 3, for example, a cap 33 will feed into a rounded slot 72 contained in indexing element 56.

Cap feeding structure 50 more specifically comprises first and second curved plate members 74, 76. Feed channel 52 is preferably a recess contained in first curved plate member 74, while second curved plate member 76 preferably encloses feed channel or recess 52, in a manner similar to second plate member 30 of cap supply cartridge 12. As further shown in FIG. 1, feed channel or recess 52 is in line with exit end 34 of feed channel 33 associated with cap supply cartridge 12. Second curved plate member 76 may be at least partially transparent to provide a visible indication of the supply of caps 33 therein. Preferably, it is formed from a clear plastic. Second curved plate member 76 may also be fastened suitably to first curved plate member 74, such as through the use of fasteners 78 disposed at both upper and lower ends of cap feeding structure 50.

Cap indexing mechanism 14 may be easily attached to crimping mechanism 11, not only at pivot connection 60, but through the use of clip members 80, 82. Clip members 80, 82 frictionally engage mechanism 11 in a releasable manner. Clip members 80 and 82, as well as guide 62 are preferably integrally formed with a support plate 84, as best shown in FIGS. 1 and 2. Support plate 84 extends upwardly and also supports replaceable cap supply cartridge 12 by way of female slide connector recess 42 formed therein as previously described in connection with FIG. 2A. Fasteners 86 are preferably used to connect cap feeding structure 50 to plate 84. Finally, a cover plate 88 is attached by fasteners 90 on top of first curved plate member 74, as shown in FIGS. 1 and 2. Cover plate 88 includes a slot 92 on its upper side for receiving index actuating member 58 during an indexing operation.

Figure 4A:
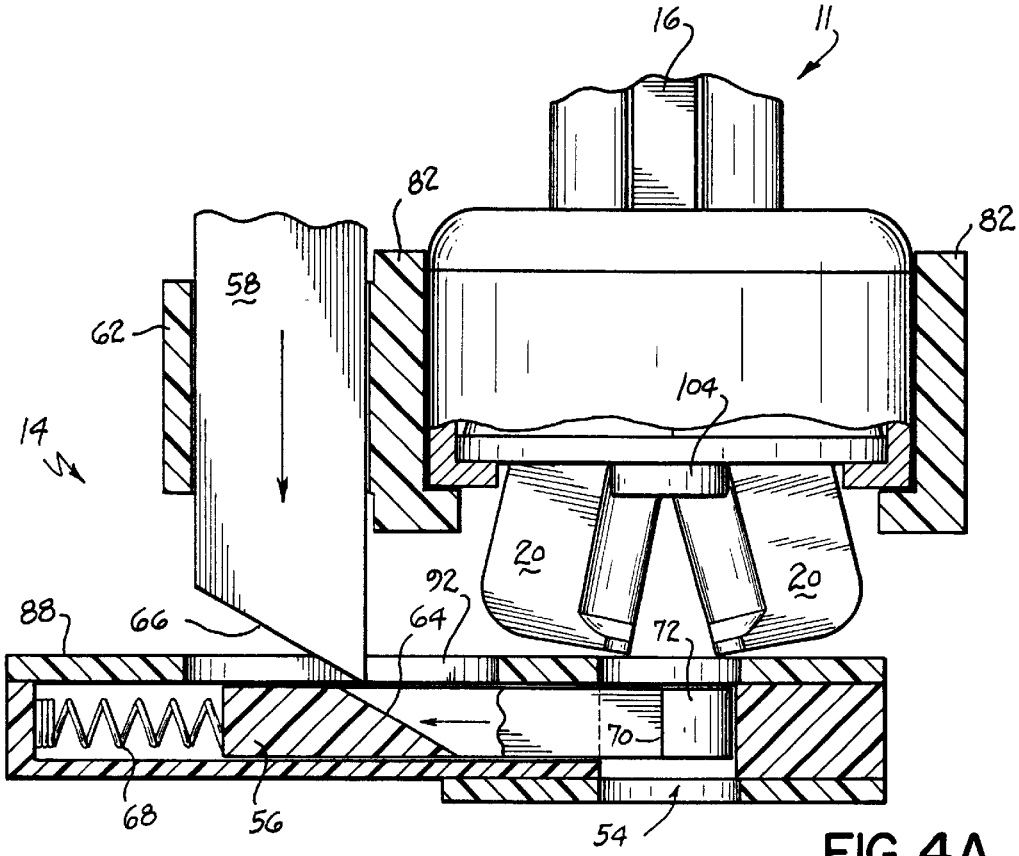
FIG. 4A is a cross sectional view of the cap crimping device, including the cap indexing mechanism, taken along line 4A—4A of FIG. 2.
Figure 4B:
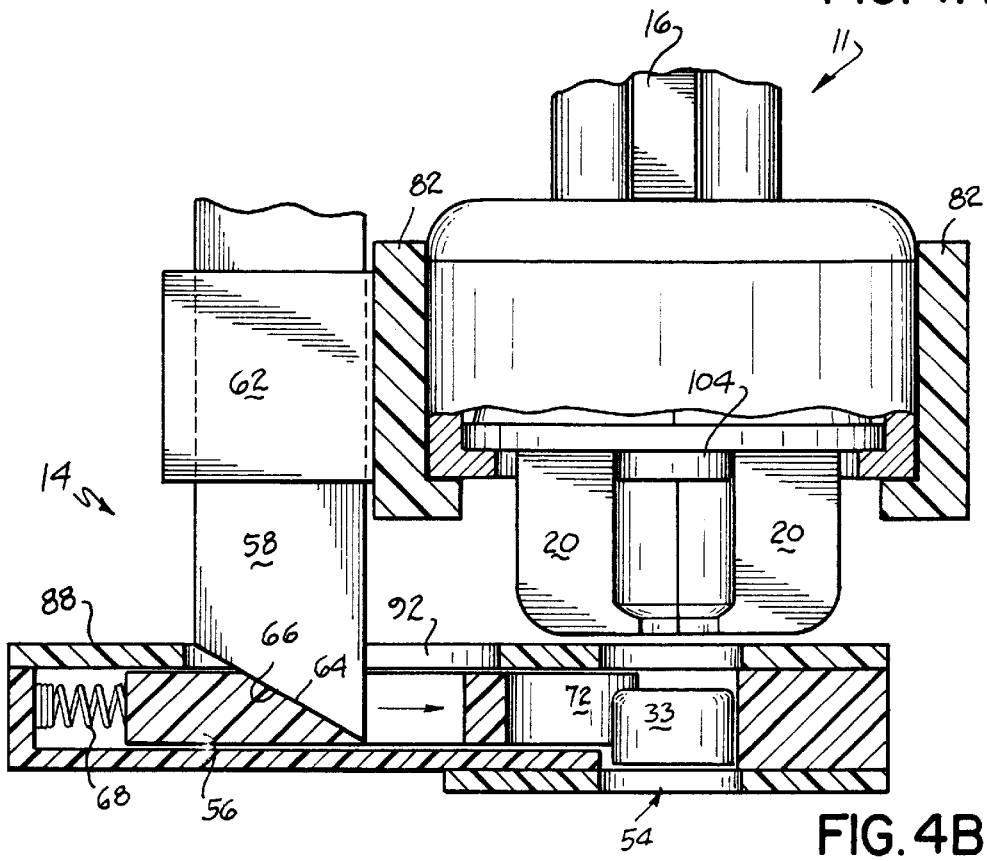
FIG. 4B is a cross sectional view similar to FIG. 4A, but showing a cap being indexed to a location proximate the crimping jaws of the device.
Figure 4C:
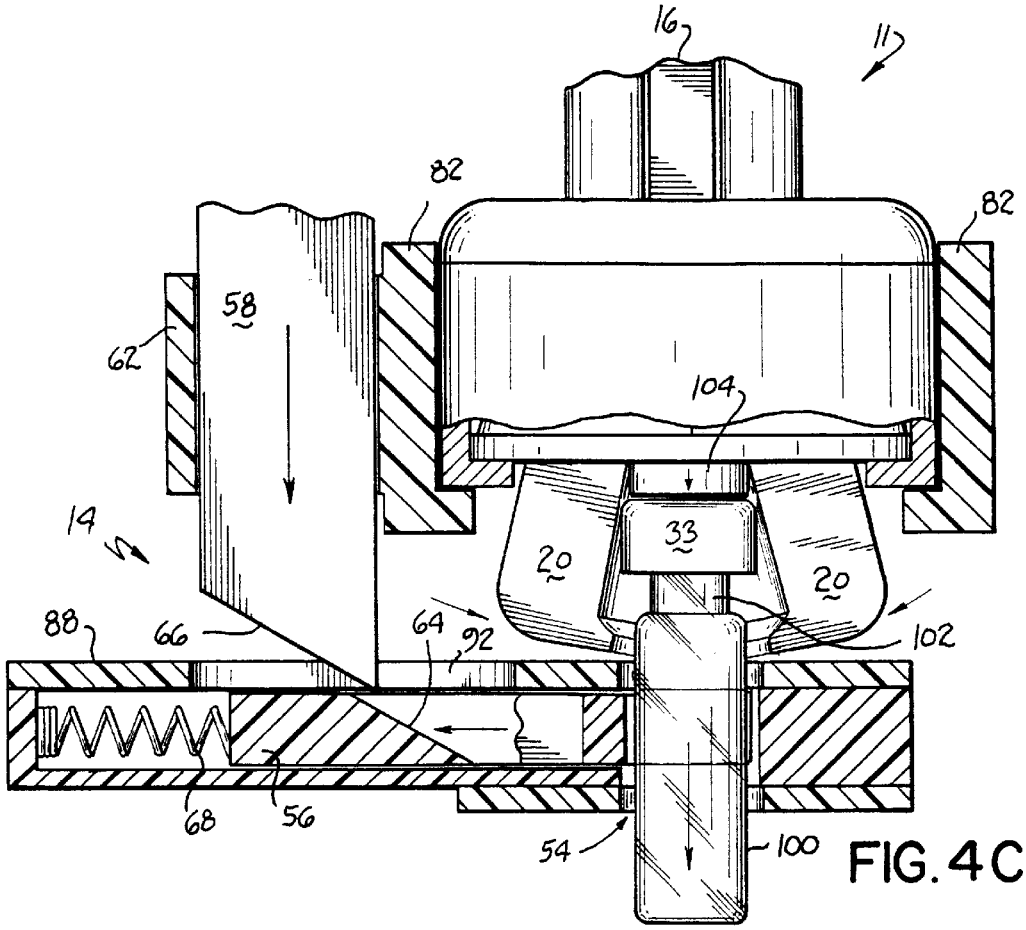
FIG. 4C is a cross sectional view similar to FIG. 4B, but showing a vial being inserted through the opening in the cap indexing mechanism such that the cap is placed over the opening in the vial and inserted into a position for crimping.
Figure 4D:
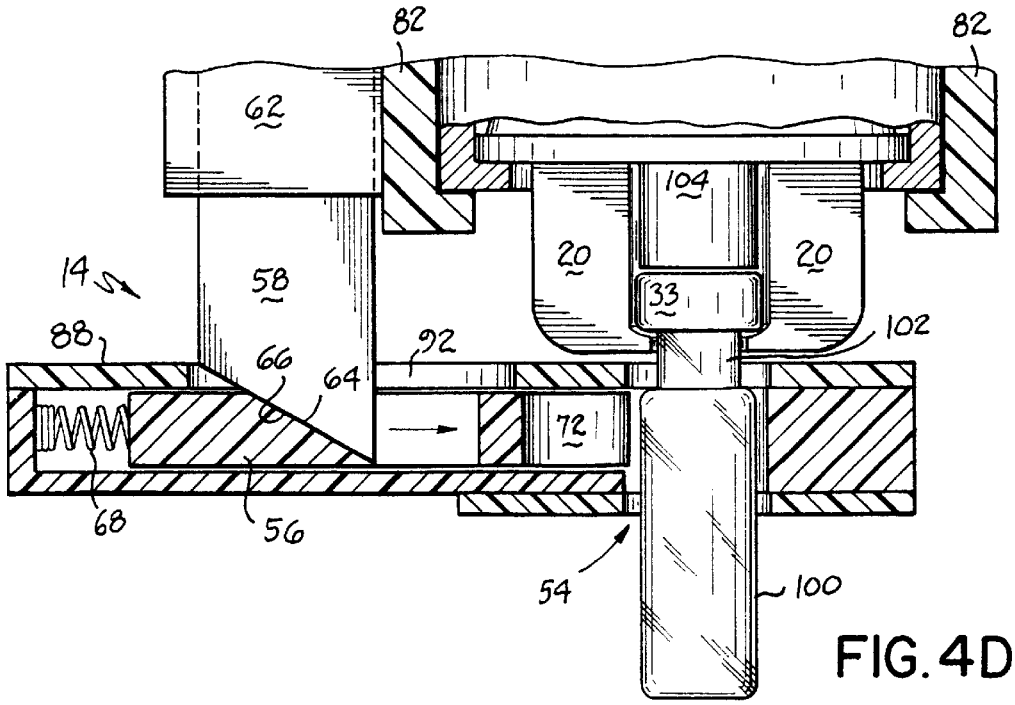
FIG. 4D is a cross sectional view similar to FIG. 4C, eliminating unnecessary detail for clarity, and showing the final crimping of the cap onto the vial.

To operate device 10, a user grasps handles 16, 18 and squeezes handle 16 toward handle 18. This moves index actuating member 58 downwardly with handle 16 and causes cam surface 66 thereof to slide against cam surface 64 of indexing element 56. Indexing element 56 therefore moves to the left, as viewed in FIG. 4A, and this opens feed channel 52 such that a cap 33 may move in line with opening 54 with an open end of cap 33 facing downwardly. As shown in FIG. 4C, the user then releases handle 16 and this lifts index actuating member 58 upward and opens jaws 20, as shown in FIG. 4C. The open end of a vial 100 is then inserted through opening 54 by the user such that a neck portion 102 and the open top of vial 100 receives cap 33. The neck portion 102 and cap 33 are then disposed generally between jaws 20 of crimping mechanism 11 as shown in FIG. 4C. Upon subsequent re-actuation of handle 16, jaws 20 move inwardly while a cap stabilizer 104 moves downwardly, in a conventional manner, to crimp cap 33 onto the neck portion 102 of vial 100, as shown in FIG. 4D.

Although a detailed description of the preferred embodiment has been described in detail above, Applicant does not intend to be bound by the details provided herein. Many modifications and substitutions for the specific components shown herein may be made without departing from the spirit of the invention. For example, many different manners of integrating the indexing mechanism and/or cartridge with the crimping mechanism may be utilized by those of ordinary skill in view of the disclosure of this invention. Also, various types of indexing elements, crimping actuators, and index actuating members may be substituted for those shown herein. With the foregoing in mind, Applicant intends to cover all aspects of the invention within the spirit and scope of the general inventive concepts disclosed herein.

What is claimed is:

1. A replaceable cap supply cartridge for a manually operated cap crimping mechanism, the cartridge comprising:

a main body having first and second opposite faces and a cap containment recess in the first face for receiving a supply of caps, the cap containment recess having an exit for serially feeding caps to the crimping mechanism; and a slide connector on the second face adapted to mate with a complementary slide connector on the crimping mechanism to allow the serial feeding of caps to the crimping mechanism.

2. The replaceable cap supply cartridge of claim 1 wherein the recess is generally serpentine-shaped and includes a side wall angled to reduce frictional contact between the recess and caps contained therein.

3. The replaceable cap supply cartridge of claim 1 wherein the cartridge further comprises a plate member attached to the first face to enclose the recess.

4. The replaceable cap supply cartridge of claim 3 wherein the plate member is transparent to allow the supply of caps to be seen by a user.

5. The replaceable cap supply cartridge of claim 1 further comprising a visible indicator of the supply of caps within the cartridge.

6. The replaceable cap supply cartridge of claim 5 wherein the cartridge is at least partially transparent to allow the supply of caps to be seen by a user.

7. The replaceable cap supply cartridge of claim 1 wherein the cartridge is attachable to the cap crimping mechanism such that the exit is located at a relative lower portion of the cartridge whereby caps may be fed to the cap crimping mechanism by gravity.

8. A replaceable cap supply cartridge for a manually operated cap crimping mechanism, the cartridge comprising:

a main body having a cap containment portion for receiving a supply of caps, the cap containment portion having an exit for serially feeding caps to the crimping mechanism; and a slide connector on the main body adapted to mate with a complementary slide connector on the crimping mechanism to allow the serial feeding of caps to the crimping mechanism;

wherein the main body includes a plate member having first and second opposite faces and the cap containment portion is a recess contained in the first face while the slide connector is disposed adjacent the exit.

* * * * *